United States Patent [19]

Herchin et al.

[11] 3,979,486

[45] Sept. 7, 1976

[54] PROCESS FOR CONTROLLING THE BALLISTIC CHARACTERISTICS OF DOUBLE-BASE PROPELLANTS

[75] Inventors: Michel A. Herchin, Saint Medard En Jalles; Jacques H. Blandin, Pontailler Sur Saone, both of France

[73] Assignee: Societe Nationale des Poudres et Explosifs, France

[22] Filed: July 27, 1973

[21] Appl. No.: 383,394

[52] U.S. Cl. ..... 264/3 B; 264/3 R; 149/100; 149/98

[51] Int. Cl.[2] ..... C06B 21/00

[58] Field of Search ..... 149/98; 264/3 R

[56] References Cited

UNITED STATES PATENTS

| | | | |
|---|---|---|---|
| 3,211,596 | 10/1965 | Kincaid et al. | 149/98 |
| 3,236,704 | 2/1966 | Axelrod et al. | 149/98 X |
| 3,364,086 | 1/1968 | Oversohl et al. | 149/98 X |
| 3,456,042 | 7/1969 | Winer | 149/98 X |
| 3,676,533 | 7/1972 | Dehm et al. | 149/98 X |
| 3,834,956 | 9/1974 | Mellow et al. | 149/98 X |
| 3,890,175 | 6/1975 | Lavitt | 149/98 X |

*Primary Examiner*—Stephen J. Lechert, Jr.
*Attorney, Agent, or Firm*—Bucknam and Archer

[57] ABSTRACT

In the preparation of double-base propellants where nitrocellulose-based granules are gelatinized by an explosive oil, the ballistic properties of the propellant are controlled by adjusting the content of nitrogen of the nitrocellulose of the granules, said content ranging from 12.6 to 14 % approximately.

6 Claims, 8 Drawing Figures

BURNING RATE mm/s
6
5
4
3
30
50
70
90
PRESSURE Kg/cm²
(SAMPLE E)

BURNING RATE mm/s
5
4
3
30
50
70
90
PRESSURE Kg/cm²
(SAMPLE F)

BURNING RATE mm/s
5
4
3
30
50
70
90
PRESSURE Kg/cm²
(SAMPLE G)

BURNING RATE mm/s
4
3
2
30
50
70
90
PRESSURE Kg/cm²
(SAMPLE H)

BURNING RATE mm/s
4
3
2
30
50
70
90
PRESSURE Kg/cm²
(SAMPLE I)

PROCESS FOR CONTROLLING THE BALLISTIC CHARACTERISTICS OF DOUBLE-BASE PROPELLANTS

BACKGROUND OF THE INVENTION

1. Field of the Invention

The invention relates to double-base propellants for use in rockets for example.

It is now understood in the art of propellants that the term "double-base propellant" means nitrocellulose-nitroglycerin propellant or, more generally, a nitrocellulose-explosive oil propellant.

More specifically, the invention relates to those double-base propellants exhibiting "plateau-effect" or "mesa-effect".

Patents relating to this art may be found for example in the following classes: 52-5, 149-96 and 98, 102-98.

2. Prior Art

Double-base compositions of this type are described for example in the U.S. Pat. No. 3,103,458.

BRIEF SUMMARY OF THE INVENTION

The present invention relates to a process for controlling the ballistic characteristics of double-base propellants.

The components of cast double-base propellants are : nitrocellulose, explosive oils, plasticizers, stabilizers, and various ingredients which are known under the general designation of combustion catalysts.

The first operation involved in the process used to cast such propellants is the manufacture of granules of a base powder, the components of which are nitrocellulose, plasticizers which may be of the explosive type, stabilizers and burning catalysts. These granules are then swollen by being gelatinized by an explosive oil which has been more or less desensitized by being treated with a plasticizer.

It is known that certain double-base propellants burn at almost constant speed within a given range of pressures. This phenomenon is often called "plateau effect" or "mesa effect", according as the slope of the speed-pressure curve within the range of pressures considered is a slope of low positive or zero gradient (plateau effect) or a slope of negative gradient (mesa effect).

This property, which increases the ballistic stability of a firing operation and, consequently, makes this operation safer, is of great interest in the manufacture of double-base propellant grains for rocket engines. Unfortunately, it is obtained only with certain compositions of double-base propellant, by incorporation of combustion catalysts. These catalysts, usually metal salts, are few in number and they modify differently the shape of the line representing the relationship burning rate-pressure or burning rate-pressure curve of the double-base propellant with which they are incorporated and, consequently, the "plateaus" are in limited number and situated at well-defined speed levels which cannot be substantially modified without the "plateau effect" or the "mesa effect" being lessened or even suppressed.

Under these circumstances, the available range of useful burning speeds is only a discontinuous range.

Till now, the nitrogen content of nitrocellulose used to manufacture double-base propellant has been equal to or less than 12,6 weight percent. This results from the fact that it is generally recognized that nitrocellulose of this type is more easily gelatined by explosive oils; in other words, the gelatinizing rate varies with the nitrogen content of nitrocellulose, and it increases when the nitrogen content decreases.

However, the applicant has discovered that the average nitrogen content of nitrocellulose has an influence on the position of the "plateau" of burning rate-pressure curves. If the average nitrogen content of nitrocellulose of this type is increased, other things being equal, it has been established that the position of the "plateau" varies continuously towards low burning rates and low pressures without any distortion of the burning rate-pressure curve, while the apparent potential and the specific impulse of the considered propellant increase, and its temperature coefficient decreases. The subject of the present invention is a process for continuously controlling the ballistic characteristics of double-base propellants and, especially, continuously controlling the "plateau" of burning rate-pressure curves specific to the said propellants without any distortion of these curves, this control being achieved by modifying the average nitrogen content of the type of nitrocellulose used to manufacture double-base propellants.

More specifically, the object of this invention is a process for continuously and significantly lowering the position of the "plateau" of the burning rate-pressure curve specific to a given double-base propellant without any distortion of this curve, this objective being achieved by increasing the average nitrogen content of the type of nitrocellulose used to manufacture the said propellant up to an average nitrogen content of 14% approximately.

A further object of the invention is a double-base propellant comprising granules of nitrocellulose having a nitrogen content higher than 12.6% gelatinized by an explosive oil.

Figure 1:
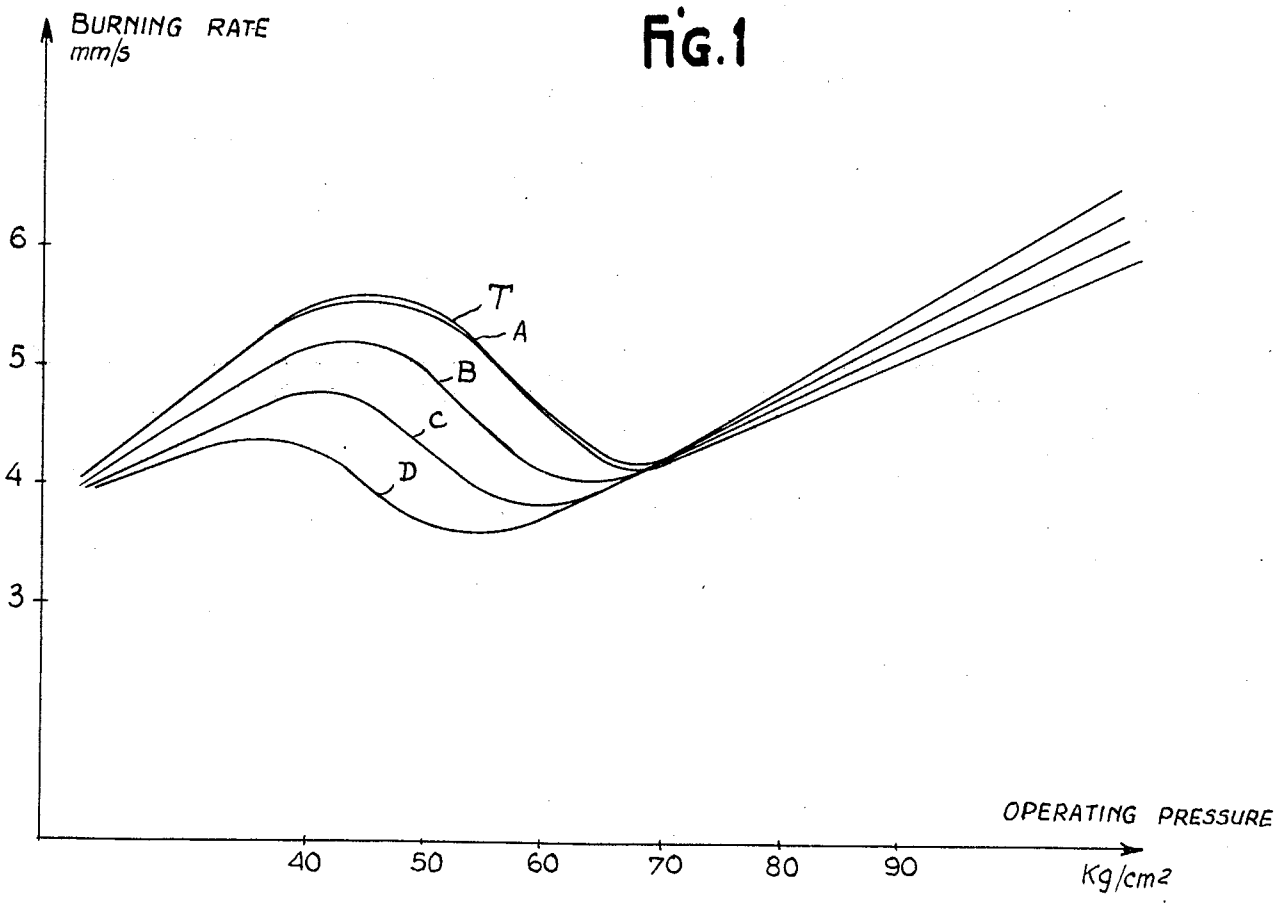
FIG. 1 shows the relationship between the burning rate and the operating pressures for a check samples and for samples of a first example of propellants according to the invention.

FIGS. **3*a*–3*e* and 4** shows the relationship between the burning rate and the operating pressures for further samples of propellants according to the invention.

DETAILED DESCRIPTION

An increase of the average nitrogen content can be achieved by incorporating a nitrocellulose comprising from 12.6 to 14 weight percent approximately of nitrogen with granules of base powder during the mixing operation, when these granules are manufactured according to the conventional extruding process from a paste which has been gelatinized by being treated with an alcohol-ether mixture or acetone-alcohol mixture, or ethyl acetate or any other volatile solvent of nitrocellulose, preference being given to an acetone-alcohol mixture because nitrocellulose with a high nitrogen content is soluble in acetone.

This process makes it possible to obtain double-base propellants with such low burning rates as had never been achieved till now.

This invention is illustrated by the following examples:

EXAMPLE I

The conventional extruding method is used to manufacture five samples of base powder from a paste which has been gelatinized by being treated with an acetone-alcohol mixture. These samples are prepared in the form of cylindrical granules approximately 1 mm in height and 1 mm in diameter, and they correspond to the compositions given in Table I below:

TABLE I

| Components | | $T_{xx}$ | | SAMPLES A | B | | C | | D |
|---|---|---|---|---|---|---|---|---|---|
| Nitro-cellulose | (N : 13.4$_x$ | 17.6 | % | 0 | 8.8 | % | 17.6 | % | 26.4 |
| | (N : 12.4 | 70.4 | % | 0 | O | | 0 | | 0 |
| | (N : 12.6 | 0 | | 88 | 79.2 | % | 70.4 | % | 61.6 |
| Dioctyl phthalate | | 5 | % | 5 | 5 | | 5 | | 5 |
| Ethyl-centralite | | 2.4 | % | 2.4 | 2.4 | | 2.4 | | 2.4 |
| Lead stearate | | 4.6 | % | 4.6 | 4.6 | | 4.6 | | 4.6 |

$_x$Nitrogen content expressed in %

$_{xx}$The nitrogen content of the check sample is the same as that of sample A, that is 12.6 weight percent.

Each of these samples is placed in a mould and a gelatinizing liquid composed of 72% nitroglycerine and 28% triacetine is injected into the mould. The granules have been packed so that the percentage of granules and the percentage of gelatinizing liquid are in the ratio of 65/35. The grain is cured during 5 days at 60° C. The burning speed is then measured in terms of pressure, this measurement being carried out:

— on strands fired in a closed bomb placed in a nitrogen atmosphere, or

— inhibited propellant grains, with a uniform burning surface, and fired in propellers having various gas volume/exhaust section ratios or "klemming".

FIG. I shows the burning rate-pressure curves corresponding to firing tests carried out on cords at 20° C, in a nitrogen atmosphere.

It is noted that:

1. The position of the "plateau" is modified and tends towards the point of origin of pressures and speeds, when one goes over the graph from curve A to curve D through intermediate curves B and C (the curves T, A, B, C, D correspond respectively to the double-base propellants obtained from the check sample T and from the samples A, B, C, D).

2. The shape of the curves on the whole remains unchanged.

Tests, where propellant grains with a uniform burning surface have been fired at three different initial temperatures (−36° C, +20° C, +56° C), confirm the decrease in burning speed.

Table II below is a summary of the results yielded by firing tests carried out on grains 150 mm in diameter and 150 mm in length burning frontally and manufactured from the above-mentioned samples (check sample T, samples A, B, C, D) in accordance with the process described above. The klemming was 485.

| Samples | Average nitrogen content | Initial temperature − 36° C effective duration (in sec.) | pressure kg/cm² (in sec.) | Initial temperature + 20° C effective duration (in sec.) | pressure kg/cm² (in sec.) | Initial temperature + 56° C effective duration (in sec.) | pressure kg/cm² |
|---|---|---|---|---|---|---|---|
| T | 12.6 | 28.3 | 43 | 24 | 49.8 | 23.5 | 50 |
| A | 12.6 | 27.7 | 43 | 24 | 52 | 23.5 | 52.5 |
| B | 12.68 | 28 | 44 | 24.5 | 51 | 24 | 52 |
| C | 12.76 | 29.1 | 42.4 | 26.9 | 46.6 | 25.5 | 49.5 |
| D | 12.89 | 30 | 41.5 | 28.9 | 43.1 | 27.2 | 47 |

Figure 2:
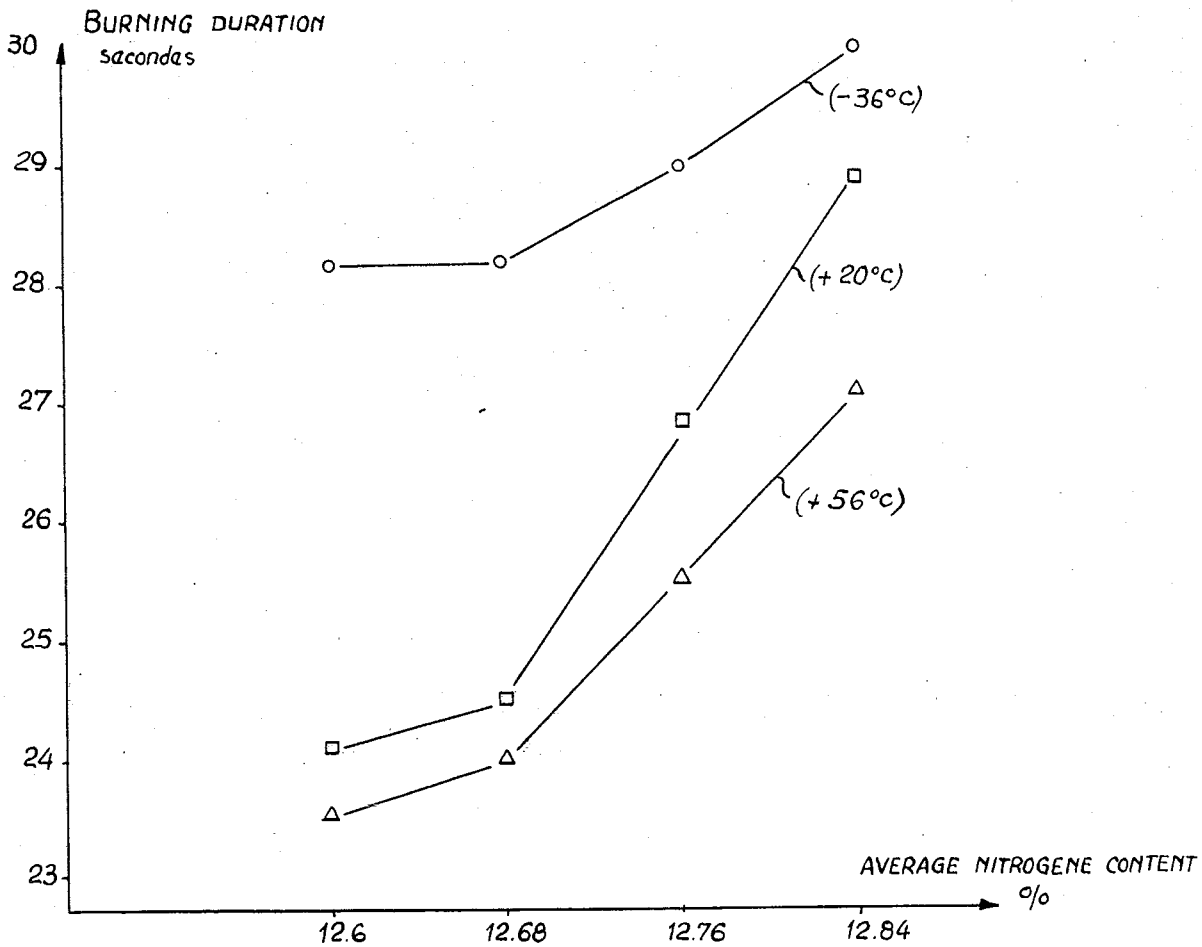
FIG. 2 shows the relationship between the burning duration and the content of nitrogen at various firing temperature.
Figures 3A, 3B, 3C, 3D, 3E:
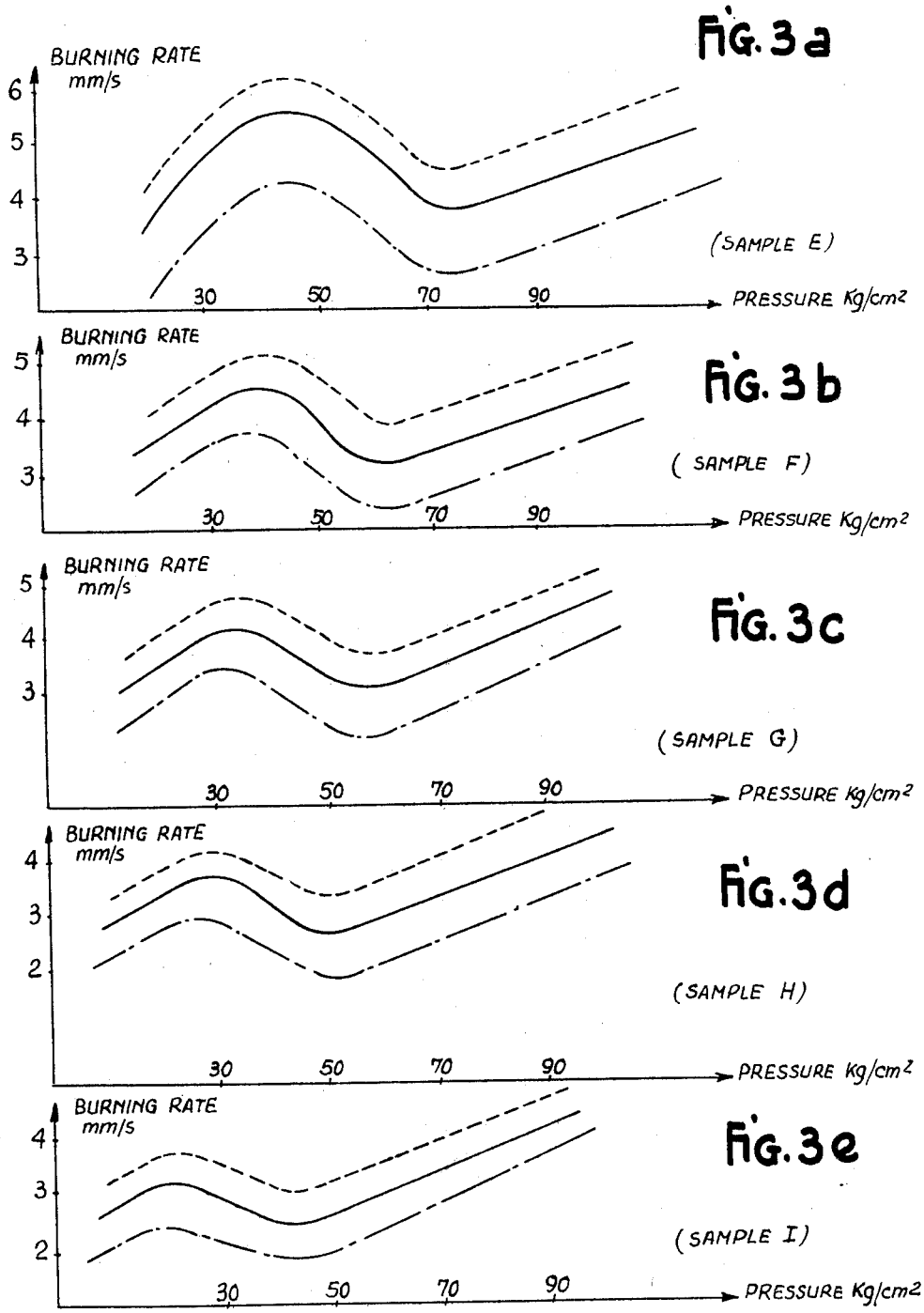

The results obtained are shown in FIG. 2 where the duration of combustion is plotted against the average nitrogen content.

From these results it appears that:

— the average nitrogen content has an influence on the duration of combustion of a grain (and its operating pressure).

— the temperature coefficient of a propellant is improved, since the higher the nitrogen content the closer the above curves are to each other.

EXAMPLE 2

In this example, a nitrocellulose with a much higher nitrogen content (for example, a nitrocellulose containing 13% or 14% nitrogen) than those of compositions of double-base propellant already known, is incorporated with the said composition.

Five examples are prepared from the following conventional composition:

| | | |
|---|---|---|
| Nitrocellulose containing 12.4 % nitrogen, | 46 | % |
| Nitrocellulose containing 13.4 % nitrogen, | 11.5 | % |
| Nitroglycerine | 25.2 | % |
| Triacetine | 9.8 | % |
| Dioctyl phthalate | 3.2 | % |
| Ethyl-centralite | 1.3 | % |
| Lead stearate | 3 | % |

but in the above composition, nitrocellulose containing 12.4% nitrogen is replaced by nitrocellulose containing 12.6% nitrogen, and nitrocellulose containing 13.4% nitrogen is replaced by gun-cotton with a very high nitrogen content (N = 13.95%).

The preparation of the samples is similar to that of samples A, B, C, D mentioned in the preceding example, i.e. the original material used is a base powder which is subsequently gelatinized in a mould by being treated with an explosive oil.

The compositions of the nitrocellulose mixtures corresponding to the samples are given in Table III below:

TABLE III

| Samples | Nitrocellulose N = 12.6 % | Nitrocellulose N = 13.95 % |
|---|---|---|
| E | 100 % | 0 % |
| F | 80 % | 20 % |
| G | 70 % | 30 % |
| H | 60 % | 40 % |
| I | 40 % | 60 % |

The burning rate-pressure curves obtained for samples E to I are plotted respectively on graphs of FIGS. 3*a* to 3*e* annexed hereto, for initial temperatures of − 36° C (double line curves) + 20° C (continuous line curves) and + 56° C (dotted line curves).

It can be noted that:

— the burning rate at + 20° C decreases proportionally to the average nitrogen content of nitrocellulose.

— the temperature coefficient (in this sample, the temperature coefficient is measured by the distance between the curves) also decreases in proportion as the percentage of nitrocellulose with a high nitrogen content increases.

— the potential of the composition increases by 14 calories/g. whenever the nitrogen content is increased by 0.1%.

EXAMPLE 3

This example is intended to show that incorporation of a type of nitrocellulose with a high nitrogen content with a composition of double-base propellant already known can be used to control the burning speed of this composition so that it corresponds to a predetermined value. The original material used in a double-base propellant with a burning rate plateau of 7 mm/sec. within a range of pressures of from 50 kg/cm2 to 100 kg/cm2 and corresponding to composition J given in Table IV below. The average nitrogen content of this double-base propellant can be increased by incorporating with the said propellant a type of nitrocellulose with a high nitrogen content (for example, N = 13.95%) which can be prepared according to the organic phase nitrating process described in the French Pat. No. 1,189,916 filed May 10, 1957. It is thus possible to obtain speeds different from the specific speed of check sample J. To this end, samples J, K, L, M are prepared according to the same process as that which is used to manufacture samples A, B, C, D in example 1.

TABLE IV

| Component | Samples J | K | L | M |
|---|---|---|---|---|
| Nitrocellulose containing 12.6 % nitrogen | 58.3 | 46.6 | 40.8 | 35 |
| Nitrocellulose containing 13.95 % nitrogen | 0 | 11.7 | 17.5 | 23.3 |
| Nitroglycerine | 25.9 | 25.9 | 25.9 | 25.9 |
| Triacetine | 9.7 | 9.7 | 9.7 | 9.7 |
| Nitrodiphenylamine | 1.6 | 1.6 | 1.6 | 1.6 |
| Dimethyl phthalate | 2.7 | 2.7 | 2.7 | 2.7 |
| Lead stearate | 1.9 | 1.9 | 1.9 | 1.9 |

Figure 4:
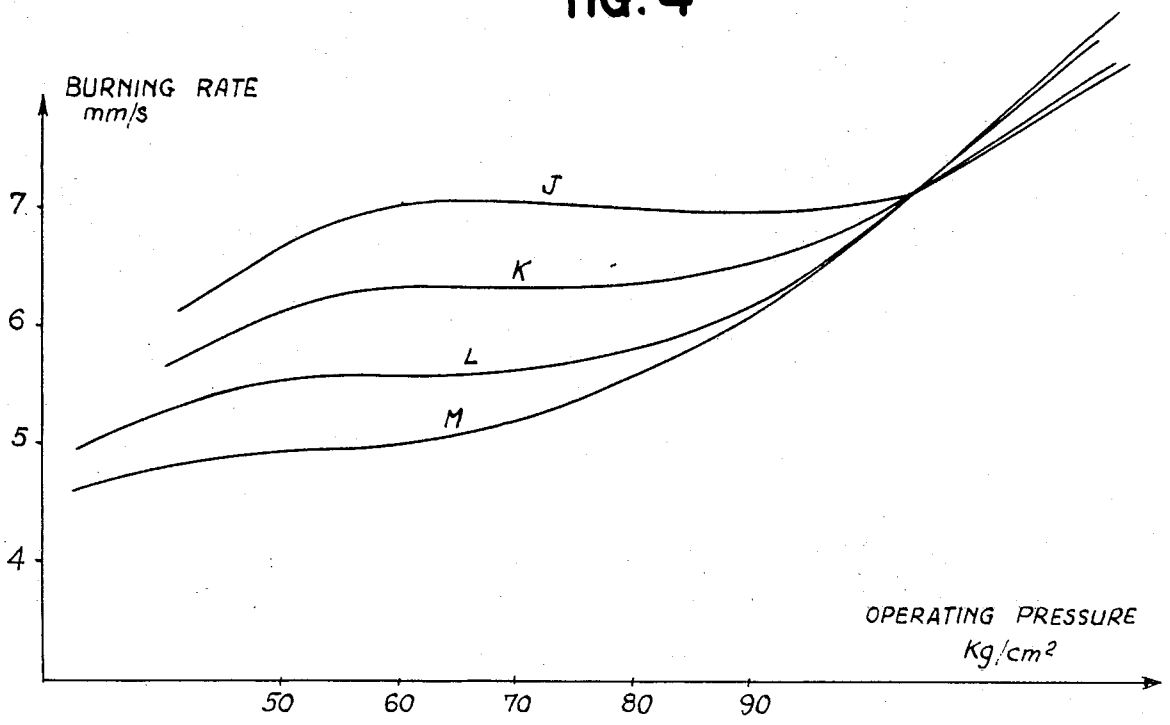

The results obtained at + 20° C by combustion of strands are marked on the graph of FIG. 4 which shows the burning rate-pressure curves.

It can be noted that:

— when the average nitrogen content is increased, the position of the "plateau" is modified and it tends towards lower speeds and pressures.

— The temperature coefficient is improved.

In conclusion, upward variation of the average nitrogen content of a given composition of double-base propellant with a burning speed of 6.5 mm/sec. results in a decrease in its burning speed and, owing to this phenomenon, control of the ballistic characteristics of this type of propellant is made possible.

However, it should be pointed out that incorporation of a nitrocellulose with a high nitrogen content in proportions higher than 60% of the nitrocellulose mixture results in a decrease in the gelatinizing speed of a cast propellant and, consequently, the period during which the grain is cured must be extended, the curing period being the longer as the percentage of nitrocellulose with a high nitrogen content is higher.

By curing the granules in the gelatinizing liquid during 20 days, propellant grains have been obtained which contain only nitrocellulose at 14% of nitrogen (56% by weight of said nitrocellulose) and the following ingredients:

— Nitroglycerine: 26%
— Lead stearate: 3%
— Triacetine: 10%
— Ethyl-centralite: 1.5%
— Dioctyl phthalate: 3.5%.

What is claimed is:

1. The process of preparing a double-base propellant composition in which the position of the plateau is shifted towards lower speeds and pressures, which consists of manufacturing granules of a base powder, the essential component of which is nitrocellulose, a portion of said nitrocellulose having a nitrogen content higher than 12.6%, and a second portion having a nitrogen content at most equal to 12.6%, in a proportion at the most 60% of the nitrocellulose of higher nitrogen content, the average nitrogen content of the granules being greater than 12.6%, the two samples of nitrocellulose differing only in the nitrogen content, and gelatinizing said granules with an explosive oil.

2. The process according to claim 1 wherein the explosive oil is nitroglycerin.

3. The process according to claim 1 wherein the nitrogen content of the nitrocellulose of higher nitrogen content is at the most 14%.

4. The process according to claim 2 wherein the explosive oil is nitroglycerin which is desensitized with a plasticizer.

5. The process according to claim 1 wherein said granules are prepared by extrusion.

6. The process according to claim 1 wherein gelatinization is carried out in a mold.

* * * * *